United States Patent [19]

Rathsam

[11] Patent Number: 4,991,530

[45] Date of Patent: Feb. 12, 1991

[54] FIN APPARATUS FOR CONTROLLING HEAT FLUX DISTRIBUTIONS

[75] Inventor: Alan D. Rathsam, San Diego, Calif.

[73] Assignee: United States of America as represented by the Secretary of the Navy, Washington, D.C.

[21] Appl. No.: 849,381

[22] Filed: Oct. 27, 1977

[51] Int. Cl.[5] ..... F42B 19/00

[52] U.S. Cl. ..... 114/20.1

[58] Field of Search ..... 114/20 R, 20.1; 165/44, 165/100, 101, 102, 119, 168

[56] References Cited

U.S. PATENT DOCUMENTS

| | | | |
|---|---|---|---|
| 2,256,393 | 9/1941 | Klein | 165/44 |
| 2,511,876 | 6/1950 | Protzeller | 165/44 |
| 2,514,105 | 7/1950 | Thomas | 165/44 |
| 3,024,606 | 3/1962 | Adams et al. | 165/168 |
| 3,382,831 | 5/1968 | Madison | 114/20 R |
| 3,448,798 | 6/1969 | Coe | 165/168 |
| 3,550,678 | 4/1969 | Pfouts | 165/44 |

*Primary Examiner*—Charles T. Jordan

*Attorney, Agent, or Firm*—Harvey Fendelman; Thomas Glenn Keough; Ervin F. Johnston

[57] ABSTRACT

A fin apparatus is provided for controlling heat flux distributions in a heated body, such as a torpedo. The torpedo may have inner and outer spaced apart shells with a predetermined ratio of conducting and nonconducting fins affixed to the shells in the space therebetween. In a torpedo it is desirable to establish the ratio so that heat will be distributed from the outer skin of the torpedo shell to improve laminar stability in the boundary layer as the torpedo travels through the water.

16 Claims, 2 Drawing Sheets

CONTROLLED HEAT FLUX DISTRIBUTION.

VARIATIONS OF RATIO OF NON-CONDUCTING FINS.

UNCONTROLLED HEAT FLUX DISTRIBUTION.

FIN APPARATUS FOR CONTROLLING HEAT FLUX DISTRIBUTIONS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention pertains to an apparatus for controlling heat flux distributions over the length of the body, such as a torpedo.

The U.S. Navy maintains a research program to improve the speed of torpedoes by reducing drag as the torpedo travels through the water. Drag on a torpedo is increased when the passing water is turbulent. The speed of a torpedo is increased when the passing water is laminar. Accordingly, the Navy has taken several approaches to improve laminar flow. It has been recognized that heat emanating from the exterior surface of any undersea vehicle, such as the torpedo, will directly affect the flow of the passing water. Accordingly, the Navy has supplied heat to the interior of vehicle shells so that the heat flux through the exterior surface will promote the desired laminar flow. In order to obtain the desired controlled heat flux distributions, thin coatings of Teflon, plastic, or other thermally insulating materials have been applied to the exterior surface of the shells. When the coating thickness is varied, the thermal resistance and resulting heat flux are altered accordingly. This approach has had the disadvantage of requiring close dimensional tolerances in order to obtain the prescribed coating thicknesses for the desired heat flux distributions. Another approach has been to vary the dimension of the heat flow passage inside the shell or to vary the number of flow passages therein. While these approaches are practical to fabricate, they do not have enough impact on heat distributions to achieve the desired results of laminar flow.

SUMMARY OF THE INVENTION

The present invention provides an easily fabricated apparatus for obtaining improved and desired heat flux distributions from the exterior surface of a body, such as a torpedo. In a torpedo this has been accomplished by providing inner and outer spaced apart shells. A ratio of conducting and nonconducting fins are affixed to the shells in the space therebetween. In a torpedo the ratio is established to distribute heat from the outer skin of the shell so as to improve laminar flow as the torpedo travels through the water. In other bodies, such as heat exchangers, the invention can be utilized to uniformly control heat flux distributions along the entire length of the body.

OBJECTS OF THE INVENTION

An object of the present invention is to provide an apparatus which will better control varied heat flux distributions from a body.

Another object is to provide an apparatus which can be designed to control an increased variation of heat flux distributions from the body than that provided by the prior art.

A further object is to provide an apparatus which will increase the speed of an underwater vehicle by more effectively reducing the drag thereon.

Still another object is to provide an apparatus for selectively controlling heat flux distributions from the exterior surface of a torpedo so as to enhance laminar flow, and thereby increase the speed of the torpedo through the water.

These and other objects of the invention will become more readily apparent from the ensuing specification when taken together with the drawing.

DESCRIPTION OF THE PREFERRED EMBODIMENT

Figure 1:
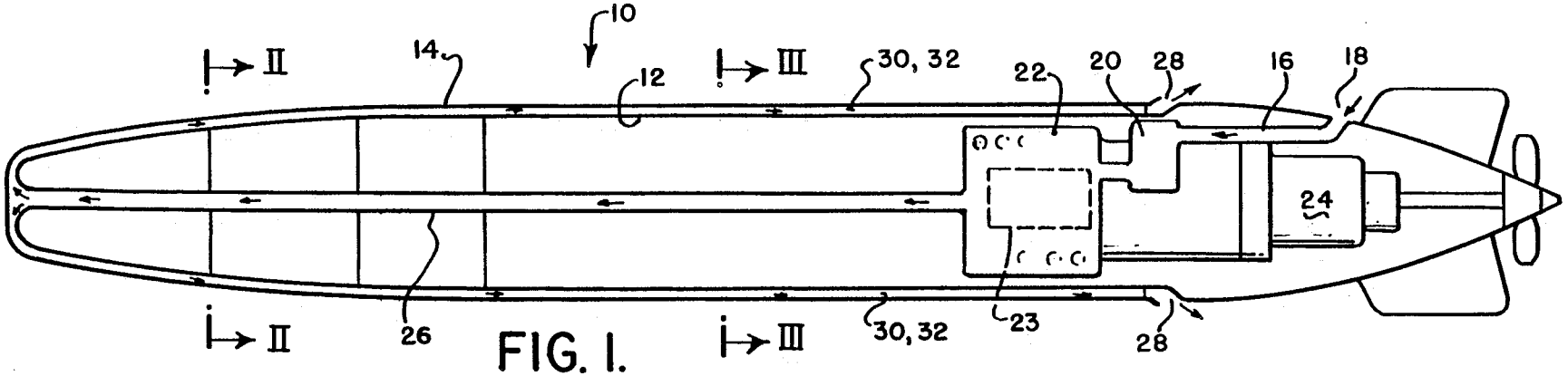
FIG. 1 is a schematic illustration of a longitudinal cross section of a torpedo illustrating an apparatus for controlling heat flux distributions from the exterior surface of the torpedo.

Referring now to the drawing, wherein like reference numerals designate like or similar parts throughout the several views, there is illustrated in FIG. 1 a torpedo 10 which may be provided with inner and outer spaced apart shells 12 and 14, respectively. The inner shell 12 may be the pressure hull and the outer shell 14 may be supplemental to an ordinary torpedo to affect the objects of the present invention. The inner shell 12 is normally constructed of metal, and the outer shell 14 is preferably a conducting material, such as metal.

A means is provided for delivering a hot liquid, such as hot seawater, to the annular space between the shells 12 and 14. This means may include a conduit 16 which connects an inlet 18 in an aft section of the torpedo to a pump 20. The pump 20 draws in seawater through the inlet 18 and delivers the seawater to a heat exchanger 22 which may receive its source of heat from a heat generator 23 and/or waste heat from the propulsion system 24. The hot seawater from the heat exchanger 22 may be delivered to the annular space between the shells 12 and 14 by a conduit 26 which extends from the heat exchanger longitudinally through the center of the torpedo to the forward portion of the annular space. The hot seawater may then flow through the annular space between the shells 12 and 14, and may be discharged through ports 28 in the aft outer shell portion of the torpedo.

Figure 4:
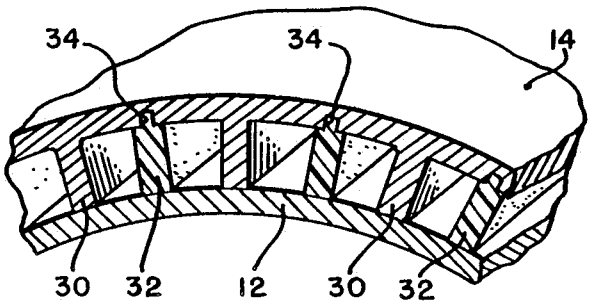
FIG. 4 is an enlarged view of a portion of FIG. 2.
Figure 3:
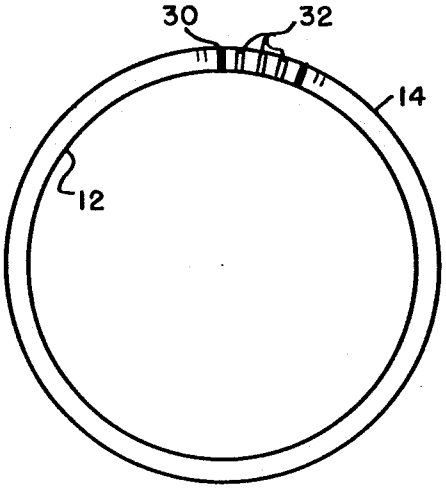
FIG. 3 is a cross-sectional view taken along plane III—III of FIG. 1.
Figure 2:
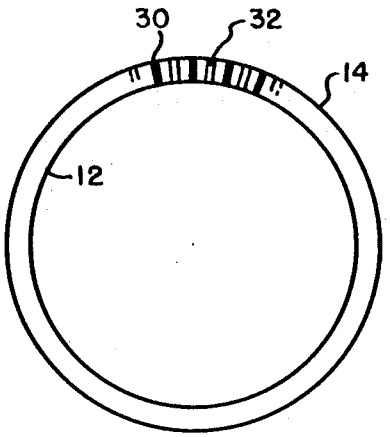
FIG. 2 is a view taken along plane II—II of FIG. 1.
Figure 5:
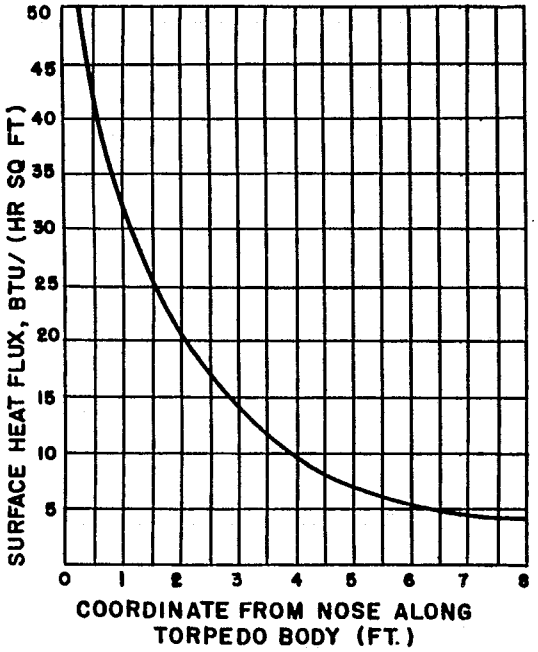
FIG. 5 is a chart illustrating uncontrolled heat flux distributions.

If the hot seawater is distributed through the annular space between the shells 12 and 14 of the torpedo without any control on the heat flux distribution, the results will be similar to that illustrated in FIG. 5. The majority of the heat will be distributed through the outer shell 14 at a forward portion of the torpedo with a rapid drop as the seawater flows towards the aft portion. While such an uncontrolled distribution will produce laminar flow of the passing water in the forward portion of the torpedo, the water passing the mid-portion of the torpedo will probably be turbulent since the heat flux distribution therefrom has become practically nil. In order to more uniformly distribute heat flux along the length of the torpedo the present invention has provided a ratio of conducting and nonconducting fins 30 and 32, respectively affixed to the shells in the space therebetween. The fins preferably extend longitudinally within the space between the shells 12 and 14, however, in other bodies the geometry may preferably be helical, lateral, or circular inside flat or curved shell surfaces. The conducting fins 30 are preferably metal, such as aluminum, and the nonconducting fins are preferably nonmetallic, such as phenolic resin. As illustrated in FIG. 4, it is preferable that the conducting fins 30 be integral with the outer shell 14 so as to provide a direct heat conducting path and, the nonconducting fins 32 may be either affixed to the inner surface of the outer shell 14 or to the outer surface of the inner shell 12. For fabrication and assembly purposes it is preferable that the nonconducting fins 32 be affixed to the inner surface of the outer shell 14 so that the outer shell 14 with both fins can be mounted on a standard torpedo. In order to affix the nonconducting fins 32 to the interior surface of the outer shell 14, the latter shell may be provided with interior grooves 34 which will receive longitudinal projections on the non-conducting fins in a force fitted relationship. It can be visualized from FIGS. 2, 3, and 4, that the conducting and non-conducting fins 30 and 32 are circumferentially spaced from one another so as to provide a longitudinal passageway for the flow of hot seawater between the inner and outer shells 12 and 14. In order to confine internal flow between the shells 12 and 14 in longitudinal directions without cross flow it is preferable that the conducting and nonconducting fins 30 and 32 maintain engagement with both shells 12 and 14. By this arrangement accurate heat flux control can be achieved.

Figure 7:
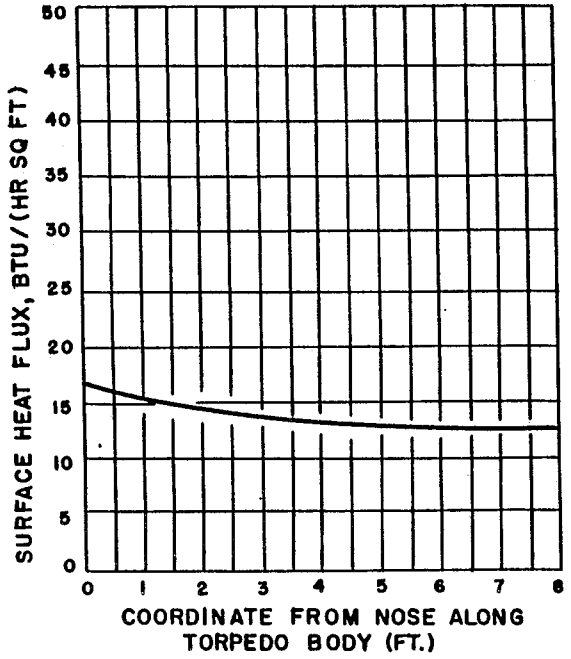
FIG. 7 is a chart illustrating heat flux distributions as controlled by the fins of the present invention.
Figure 6:
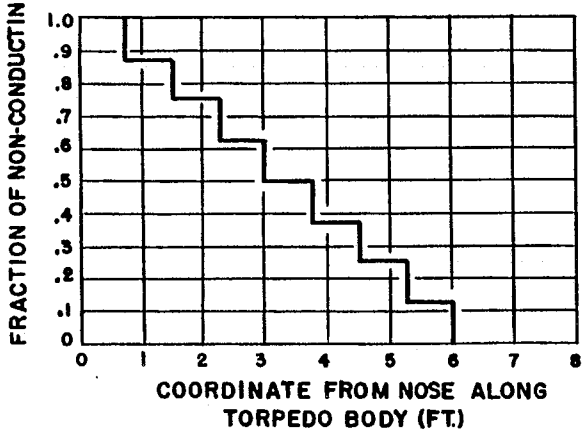
FIG. 6 is a chart illustrating various ratios of conducting and nonconducting fins to control heat flux distributions.

In order to achieve the more even distribution of heat flux from the outer shell 14, as mentioned hereinabove, the ratio of conducting to nonconducting fins, 30 and 32, respectively, is varied along the length of the torpedo within the annular space between the inner and outer shells 12 and 14. Since the seawater is hotter at the fore end of the torpedo, there will be more nonconducting fins in the fore end of the torpedo so as to slow the heat flux distribution therefrom. The ratio can be gradually changed toward the aft end of the torpedo as illustrated by the chart in FIG. 6. This chart illustrates that at the fore end of the torpedo the fins may be all nonconductive, and then shortly thereafter the ratio may change to including a few conducting fins, and so on until near the aft end of the torpedo all of the fins are of the conducting type. By discretely changing the ratio of conducting to nonconducting fins, according to the pattern, such as FIG. 6, a desired controlled heat flux distribution through the outer shell 14 of the torpedo can be approached, such as that illustrated in the chart of FIG. 7 of the drawing. In this manner, heat flux through the outer shell 14 of the torpedo can be tailored so as to achieve an improved laminar flow of the water passing the exterior surface of the torpedo 10.

The present invention provides many advantages. The nonconducting fins reduce heat transfer by masking primary heat transfer area on the inside surface of an outer shell. Further, the nonconducting fins allow heat exchanger geometries to utilize flow passages having small hydraulic radii. This increases the likelihood that the internal heat exchanger flow will be laminar and therefore quieter for torpedo applications. Also, nonconducting fins may extend between the inner and outer shells such that each fin maintains contact with both shells. This confines the internal flow in the heat exchanger to the longitudinal direction of the fins and eliminates the development of cross flows which cannot be tolerated if accurate heat-flux control is to be achieved.

Obviously, many modifications and variations of the present invention are possible in light of the above teachings, and, it is therefore understood that the invention may be practiced otherwise than as specifically described.

What is claimed is:

1. In a torpedo having inner and outer spaced apart shells, the improvement comprising:

a plurality of conducting fins and a plurality of nonconducting fins affixed to the shells in the space therebetween; and the number of conducting fins to the number of nonconducting fins being established at a predetermined ration to distribute heat from the outer skin of the outer shell into an ambient water environment about the torpedo, whereby laminar flow of water past the outer shell can be improved as the torpedo travels through the water.

2. The combination as claimed in claim 1 including:

said fins extending radially with respect to the longitudinal axis of the torpedo in an alternate conducting fin and nonconducting fin relationship.

3. The combination as claimed in claim 1 including:

the conducting fins being metallic and the nonconducting fins being non-metallic.

4. The combination as claimed in claim 1 including:

the conducting fins being integral with the outer shell.

5. The combination as claimed in claim 1 including:

said ratio varying along the length of the torpedo.

6. The combination as claimed in claim 5 including:

the ratio of conducting to nonconducting fins increasing along the torpedo from the nose toward the tail of the torpedo.

7. The combination as claimed in claim 6 including:

said fins extending radially with respect to the longitudinal axis of the torpedo in an alternate conducting fin and nonconducting fin relationship.

8. The combination as claimed in claim 7 including:

the conducting fins being metallic and the nonconducting fins being non-metallic.

9. The combination as claimed in claim 8 including:

the conducting fins being integral with the outer shell.

10. The combination as claimed in claim 9 including:

means for delivering a hot pressurized liquid to the space between the inner and outer shells.

11. The combination as claimed in claim 10 including:

the conducting and nonconducting fins each engaging both the inner and outer shells along their longitudinal lengths so as to form separate longitudinal passageways.

12. A heat distribution apparatus for a body comprising:

an outer shell mounted about the body in a spaced relationship;

a plurality of conducting fins and a plurality of nonconducting fins mounted in the space between the body and said outer shell; and the number of conducting fins to the number of non-conducting fins being established at a predetermined ratio to distribute heat from the outer skin of the outer shell into an ambient environment about the body.

13. An apparatus as claimed in claim 12 including:

the apparatus being elongated;

the conducting fins being metallic and the nonconducting fins being nonmetallic;

said fins extending radially with respect to the longitudinal axis of the apparatus in an alternate conducting fin and non-conducting fin relationship; and the outer shell being metallic with the metal fins being integral therewith.

14. An apparatus as claimed in claim 13 including:

the ratio of conducting to nonconducting fins increasing along the length of the body.

15. An apparatus as claimed in claim 14 including:

means for delivering a hot pressurized liquid to the space between the body and said shell.

16. An apparatus as claimed in claim 15 including:

the conducting and nonconducting fins each engaging both the body and outer shell along their longitudinal lengths so as to form separate longitudinal passageways.

* * * * *